US005722622A

United States Patent [19]

Gustafson

[11] Patent Number: 5,722,622

[45] Date of Patent: Mar. 3, 1998

[54] STABLE-SLIDE SELF-FEEDING ASSISTIVE DEVICE

[76] Inventor: Norman P. Gustafson, 2508 Collins Rd., Pittsburgh, Pa. 15235

[21] Appl. No.: 669,150

[22] Filed: Jun. 24, 1996

[51] Int. Cl.[6] ..... A47C 7/54

[52] U.S. Cl. ..... 248/118

[58] Field of Search ..... 248/118, 228.6, 248/231.71, 291.1

[56] References Cited

U.S. PATENT DOCUMENTS

| | | | |
|---|---|---|---|
| 1,892,048 | 12/1932 | Genung | 297/412 |
| 2,477,898 | 8/1949 | Rehman et al. | 248/118 |
| 2,614,558 | 10/1952 | Lovell | 248/118 |
| 3,103,386 | 9/1963 | Kerr | 297/416 |
| 3,323,144 | 6/1967 | Ferris | 297/416 |
| 4,277,213 | 7/1981 | Morewood | 414/9 |
| 4,433,950 | 2/1984 | Hanger et al. | 414/9 |
| 4,522,543 | 6/1985 | Robinson | 414/9 |
| 4,576,351 | 3/1986 | Brink | 248/118 |
| 4,821,417 | 4/1989 | Levine | 30/298 |
| 4,997,054 | 3/1991 | Denny et al. | 348/118 X |
| 5,037,261 | 8/1991 | Morewood | 414/9 |
| 5,169,103 | 12/1992 | Jimenez et al. | 248/118 |
| 5,184,795 | 2/1993 | Sexton | 248/118 |
| 5,277,392 | 1/1994 | Rossman et al. | 248/231.71 |
| 5,281,001 | 1/1994 | Bergsten et al. | 248/118 X |
| 5,282,711 | 2/1994 | Frische | 414/9 |
| 5,288,042 | 2/1994 | Grimm | 248/231.71 X |
| 5,373,643 | 12/1994 | Warren | 30/322 |
| 5,385,322 | 1/1995 | Kim et al. | 248/118 |
| 5,398,896 | 3/1995 | Terbrack | 248/118 X |
| 5,402,972 | 4/1995 | Schmidt | 248/118 |
| 5,405,109 | 4/1995 | Nordnes | 248/231.71 X |

OTHER PUBLICATIONS

"Ball Bearing Feeder" Known since 1940 (See enclosed sheet) I don't know inventor's name.

*Primary Examiner*—Wynn E. Wood
*Assistant Examiner*—Beth A. Aubrey
*Attorney, Agent, or Firm*—Arnold B. Silverman; Eckert Seamans Cherin & Mellott, LLC

[57] ABSTRACT

A portable, adjustable device which provides support, tactile feedback, and mechanical advantage to individuals with weakness, tremors, or poor motor control during the activity of self-feeding. The device consists of a base for attaching the device to various sized tables, a support slide holder and a support slide. During typical operation, once adjustments have been made and tightened down, the user places his or her arm in the bottom portion of the support slide and with support of the support slide, slides the arm toward the mouth until it rests in the top portion of the support slide wherein the user is able to consume a bite of food. The base of the device clamps to various size tables. The support slide is connected to the base through a support slide holder which allows vertical and horizontal adjustment of the support slide. The support slide itself is arced in the horizontal and vertical planes in a fashion that approximates the arc of the arm during non-supported self-feeding. The support slide includes specially shaped segments at the top and bottom for additional control for the user in these areas.

5 Claims, 2 Drawing Sheets

STABLE-SLIDE SELF-FEEDING ASSISTIVE DEVICE

BACKGROUND

1. Field of Invention

This invention relates to a device to be used by individuals who can not feed themselves effectively due to weakness, tremors or poor motor control. More specifically, it relates to a device that provides support, guidance, tactile feedback and biomechanical advantage for the user's arm as food is lifted from the eating surface to the mouth.

2. Description of Prior Art

According to the U.S. Census Bureau, over 480,000 Americans require the assistance of another person to feed themselves. Causes of inability to feed oneself include upper extremity weakness, tremors and motor control problems. These impairments may be the result of neuromuscular disorders such as Multiple Sclerosis, Parkinson's, Muscular Dystrophy, Cerebral Palsy and others.

The ability to feed oneself develops in early childhood and consists of grasping and manipulating a utensil to obtain a small portion of food. With use of shoulder, elbow, forearm and hand musculature, the food is brought to the mouth in a smooth, controlled fashion. Loss of this primary self-care function results in diminished self esteem. Additionally, caregiver demands are increased when a person can not feed him or herself independently.

Devices designed to overcome this problem that have been disclosed fall into two general categories; devices that change the standard plate or utensil configuration and devices that electronically or mechanically place a small portion of food in front of the user's mouth. U.S. Pat. Nos. 4,821,417 [Levine] and 5,373,643 [Warren] both disclose devices for enabling a person with limited grasping ability to operate a utensil. They do not, however, provide any assistance in bringing food to the mouth. U.S. Pat. Nos. 5,282,711 [Frische], 4,277,213 [Morewood], 4,433,950 [Hanger, Walter], 4,522,543 [Robinson], all disclose devices that by various means enable the user to position food in front of the mouth without the use of the arms. They are generally costly and provide more assistance than is needed by individuals with less severe weakness or tremors. Additionally, a ball-bearing type feeder has been known since the 1940's. This device provides support for the arm while utilizing a pivot arrangement to assist the user in bringing food to the mouth. This device is difficult for caregivers to set up and since it is mobile does not provide the type of support needed by individuals with tremors.

OBJECTS AND ADVANTAGES

It is an object of this invention to provide the support, guidance, tactile feedback and mechanical advantage required for a person with weakness, motor control problems or tremors to feed themselves independently.

It is a further object of this invention to provide a device which is capable of adjustment to meet the demands of different users and the changing demands of an individual user.

It is yet another object of this invention to provide a device that is easy and quick for caregivers to set up.

It is another object of this invention to in addition to self-feeding, to provide a device that can provide assistance in the self-care functions of oral and facial hygiene.

To accomplish these objects, the invention consists of three main parts; a base, a support slide and a support slide holder. The function of the base is to secure the device to various sized tables. The function of the support slide holder is to allow angle adjustability in the horizontal and vertical planes and attachment for the support slide. The function of the support slide is to provide control points for the user's arm at the top and bottom and a curved surface for the arm to follow when bringing food to the mouth.

The base consists of a top surface at five inches square and an inch thick with two 90 degree angle bends and a bolt and thread arrangement allowing attachment to a table in a "C" clamp fashion. The support slide holder bottom is a flat surface which lies directly on the base and is parallel to it. The support slide holder bottom can pivot on the base in the horizontal plane and then bolt to the base in the desired position. The support slide holder also has two upright sections that allow pivoting of the support slide in the vertical plane and then locking in place in the desired vertical angle. The support slide is a curved surface at 3 inches wide and gently arcs in both the horizontal and vertical planes approximating the natural arc of the arm when bringing food from the plate to the mouth. The support slide has a bottom "stop" and a top "rest" for extra control in these areas.

DESCRIPTION OF PREFERRED EMBODIMENT

Figure 1:
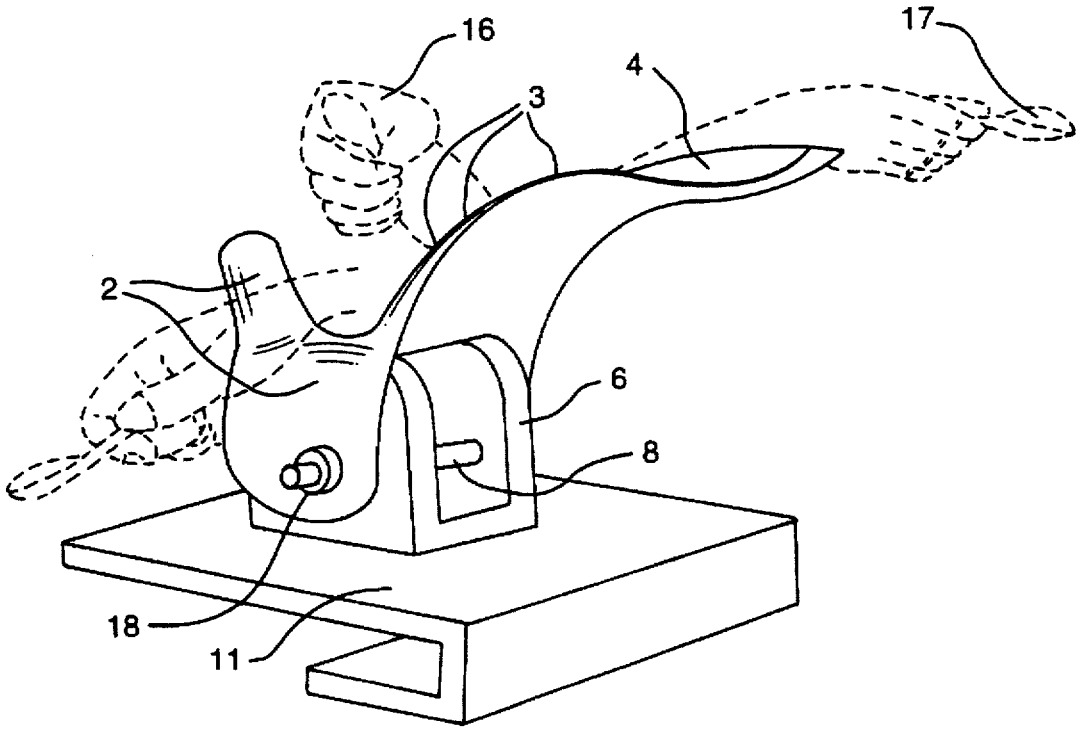
FIG. 1 shows an isometric view of the entire device including a user's arm indicating typical operation.
Figure 3:
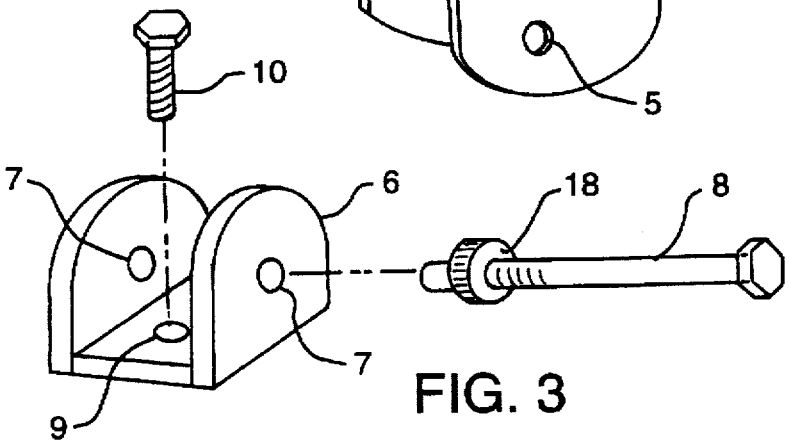
FIG. 3 shows an isometric view of the support slide holder and associated hardware.
Figure 4:
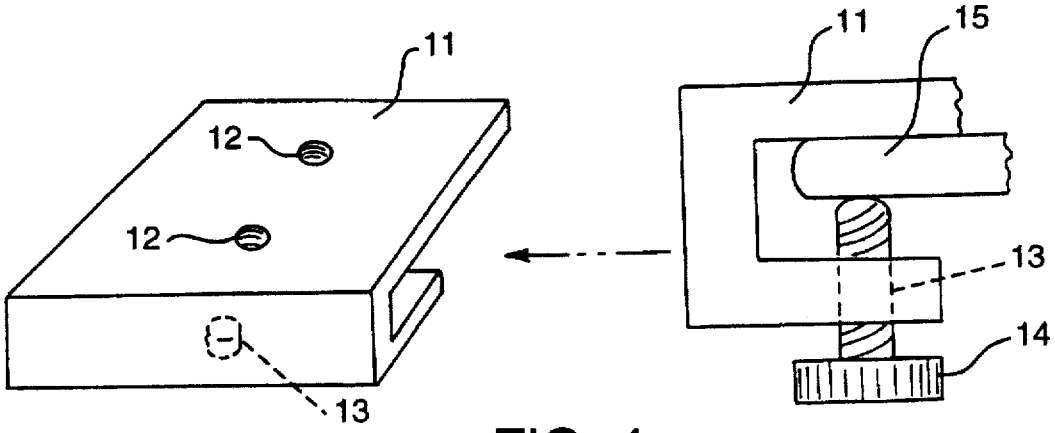
FIG. 4 shows both an isometric view and detail view of the base.

With reference to FIG. 1, there is shown a typical embodiment of the present invention. Specifically, the device includes a support slide 1 (FIG. 2), a holder 6 (FIG. 3), and a base 11, (FIG. 4). As illustrated in FIG. 1, the device may be used for guiding and supporting a person's arm 16 during self feeding activity. In addition, it should be recognized that the device is also capable of providing assistance in other activities, such as, self care functions including, for example, oral and facial hygiene. Advantageously, the device allows for a person with weakness, motor control problems or tremors to feed themselves independently and provides support, guidance, tactile feedback and mechanical advantage for a person having difficulty with such activities.

Figure 2:
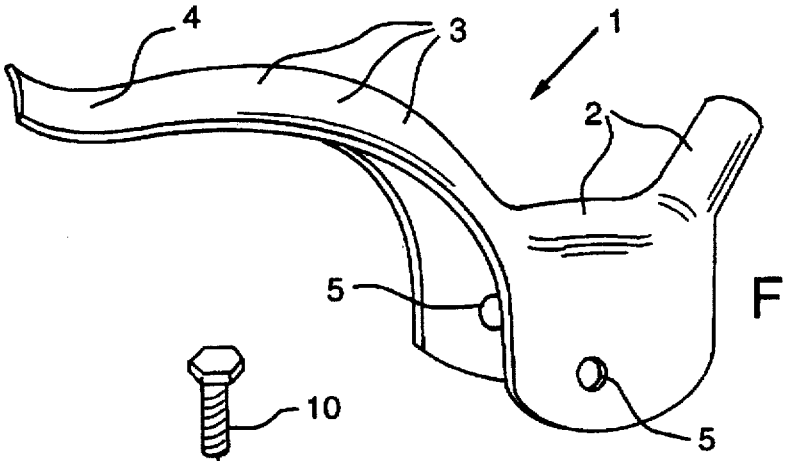
FIG. 2 shows an isometric view of the support slide.

With specific reference to FIG. 2, there is shown an isometric view of the support slide 1. The support slide 1 includes a bottom stop or bottom support 2, a top rest or top support 4 and a slide portion 3 positioned between the top and bottom supports. Bottom support 2 is preferably formed in a concave shape along a longitudinal axis of the support slide for comfortably receiving a person's arm 16. Similarly, top support 4 is also formed in a concave shape. The slide portion 3 is preferably formed in a convex shape so as to allow for a person's arm 16 to comfortably slide from the bottom support 2 to the top support 4 and then back to the bottom support once again. A stop portion of the bottom support 2 extends substantially upward therefrom so as to prevent a person's arm 16 from becoming separated from the support slide 1 when moving from the top support 4 position back to the bottom support 2 position.

Preferably, the support slide 1 is pivotally mounted to holder 6 by positioning the unthreaded holes 5 of the support slide (FIG. 2) adjacent the unthreaded holes 7 of the holder (FIG. 3) and then extending the threaded adjustment bolt 8 through the cooperating sets of unthreaded holes 5,7. Advantageously, by pivotally mounting the support slide 1 to the holder 6, the vertical orientation of the support slide with respect to the holder may be adjusted in order to meet the requirements of the individual user. Once the support slide 1 is vertically adjusted to meet the individual users requirements, adjustment bolt nut 18 is provided for locking the support slide in a set vertical position. Advantageously, this ensures that the support slide 1 will remain in a constant position during use, while also allowing for easy adjustment of the support slide if necessary.

The holder 6 is preferably rotatably mounted to the base 11. Specifically, holder 6 includes an unthreaded hole 9 through which threaded bolt 10 can be extended for receipt in threaded hole 12 of base 11. Advantageously, this provides for the horizontal orientation of the device to be adjusted by rotating the holder 6 with respect to the base 11. Once the device is in a position which meets the requirements of the individual user, the holder 6 can be secured to the base plate 11 by tightening the threaded bolt 10. Once fully tightened, the holder 6 is secured to the base 11 in a set horizontal position. However, the horizontal orientation can be easily adjusted if necessary.

As shown in FIG. 4, the device may be removably attached to a table 15. Specifically, set screw 14 is provided for removably attaching the base 11 to the table 15. The base 11 includes threaded hole 13 for passing set screw 14 therethrough. Thus, it should be appreciated that an important aspect of the present invention is the ease with which the device may be attached to a table 15 and the numerous types of tables to which the device may be attached.

Operation—FIGS. 1–4

To set up the device for use, adjustments are first made so that the device meets the requirements of the individual user. The base 11 is positioned to the left or right of the user's plate depending on arm preference and clamped to the table 15 using the set screw 14. It should be understood that a right or left version of the device will be required depending on arm preference and that the drawings depict a right version. The horizontal orientation is then set by rotating the support slide holder 6 with respect to the base 11 until the desired horizontal orientation is obtained. Generally the support slide holder 6 and the support slide 1 will be pointing toward the user's mouth. The support slide holder 6 is then secured to the base by tightening the bolt to fasten support slide holder to base 10. The preferred vertical orientation of the support slide 1 is then obtained by observing the user as different vertical orientations are tried. When the preferred vertical orientation is obtained the support slide 1 is fastened to the support slide holder 6 by tightening the adjustment bolt 8 with the adjustment bolt nut 18. Once adjustments are made, the user then places their arm in the area of the bottom "stop" or support 2. The bottom "stop" or support 2 supports the arm 16 as food is obtained with a utensil 17. The user then slides the arm up the slide transition from bottom position to top 3 until the arm rests in the top "rest" support 4. The user's arm is then in a stable position with the utensil full of food located near the mouth. The user eats the food and is ready to repeat the process.

In summary, numerous benefits result from employing the concepts of the present invention. The device of the present invention is particularly user friendly and convenient to set up and adjust to meet the requirements of an individual user. In addition, the effectiveness and overall simplicity of the device represents a significant advance over prior art self-feeding assistive devices. Specifically, the ability to easily adjust the vertical and horizontal orientations of the device allow for the quick adjustment of the device, either by the user or a caregiver, to meet the requirements of the user. In addition, the concave shape of the bottom and top supports 2, 4 of the support slide 1 allow the user to comfortably perform the task being attempted while receiving adequate support. The convex shape of the slide portion 3 advantageously provides for a smooth transition between the bottom and top supports 2,4.

Whereas a preferred embodiment of the present invention has been described herein for purposes of illustration only and it will be evident to those skilled in the art that numerous variations of the details may be made without departing from the invention as defined in the appended claims.

I claim:

1. A device for guiding and supporting a persons arm, said device being removably attachable to a table, said device comprising:

a support slide, a holder and a base;

said support slide having a bottom support, a top support, and a slide portion between said bottom and top supports;

said support slide pivotally mounted to said holder and pivotable about a generally horizontal axis of said device;

said base having attachment means for removably attaching said device to said table; and said holder rotatably mounted to said base and rotatable about a generally vertical axis of said device.

2. The device of claim 1 wherein said bottom and top supports have a generally upwardly concave shape along a longitudinal axis of said support slide; and said slide portion having a generally downwardly convex shape along said longitudinal axis.

3. The device of claim 2 wherein said bottom support includes a stop extending generally substantially upward from said bottom support.

4. The device of claim 1 further including means for locking said support slide to said holder in a set vertical position following vertical adjustment of said support slide with respect to said holder.

5. The device of claim 1 further including means for securing said holder to said base in a set horizontal position following horizontal adjustment of said holder with respect to said base.

* * * * *